US006257092B1

(12) United States Patent
Gort-Barten

(10) Patent No.: US 6,257,092 B1
(45) Date of Patent: Jul. 10, 2001

(54) CORKSCREW ASSEMBLY

(75) Inventor: Leslie Alexander Gort-Barten, London (GB)

(73) Assignee: Dualit Limited, London (GB)

( * ) Notice: Subject to any disclaimer, the term of this patent is extended or adjusted under 35 U.S.C. 154(b) by 0 days.

(21) Appl. No.: 09/367,478

(22) PCT Filed: Feb. 10, 1998

(86) PCT No.: PCT/GB98/00411

§ 371 Date: Oct. 15, 1999

§ 102(e) Date: Oct. 15, 1999

(87) PCT Pub. No.: WO98/35906

PCT Pub. Date: Aug. 20, 1998

(30) Foreign Application Priority Data

Feb. 13, 1997 (GB) ..... 9702913
Jun. 13, 1997 (GB) ..... 9712344

(51) Int. Cl.[7] ..... B67B 7/18
(52) U.S. Cl. ..... 81/3.29; 81/3.36
(58) Field of Search ..... 81/3.07, 3.09, 81/3.15, 3.35, 3.36, 3.29, 3.45

(56) References Cited

U.S. PATENT DOCUMENTS 276,804 * 5/1883 Green ..... 81/3.29
D. 359,213 * 6/1995 Entwistle ..... 81/3.29
613,176 * 10/1898 Stiles ..... 81/3.29
1,030,698 * 6/1912 Wilson ..... 81/3.29
4,276,789 * 7/1981 Allen ..... 81/3.36
4,727,779 * 3/1988 Lee ..... 81/3.29
5,079,975 * 1/1992 Spencer, Jr. ..... 81/3.29

FOREIGN PATENT DOCUMENTS 0 056 011 7/1982 (EP) .
008711 * 4/1901 (GB) ..... 81/3.29
004391 * 2/1907 (GB) ..... 81/3.29

* cited by examiner

*Primary Examiner*—Eileen P. Morgan
*Assistant Examiner*—Joni B. Danganan
(74) *Attorney, Agent, or Firm*—Lahive & Cockfield, LLP

(57) ABSTRACT

A corkscrew assembly of the self-pull type having a screw member and a holding member. The lower end of the screw member is adapted to be inserted into a cork and an upper end secured to a handle by which the screw member can be rotated. The holding member has a body formed with a bore to loosely receive the screw and a pair of arms adapted to engage a bottle. The lower part of the handle has a projecting portion that snap fits into the bore of the holding member to retain the members together against inadvertent separation.

7 Claims, 3 Drawing Sheets

CORKSCREW ASSEMBLY

FIELD OF INVENTION

This invention relates to a corkscrew and corkscrew assembly.

BACKGROUND OF THE INVENTION

Corkscrews conventionally comprise a screw, which may be in the form of a wire wound helically about an axis, having a point at its lower end for initial insertion into a cork and having a handle at the upper end to aid rotation. The handle conventionally has two similar arms extending symmetrically outwardly on opposite sides of the axis and substantially normal to the axis.

Since the corkscrew is usually gripped in one hand while the bottle is held with the other hand and the handle and helix are then rotated relative to the bottle about the axis this arrangement of handle is not the most convenient from an ergonomic point of view.

Where a corkscrew assembly is of the self pull type, having a screw handle and a holder to grip the bottle neck, in a known assembly disclosed in EP-A-0129301, the screw and handle are permanently retained against separation although they can move axially relative to one another with the screw closely engaging in a bore in the holder.

SUMMARY OF THE INVENTION

According to the present invention the handle of a corkscrew has three equi-angularly spaced arms extending outwardly from and symmetrically about the axis of the screw.

Preferably each arm has a substantial depth parallel to the axis of the screw and preferably a depth of at least 20 mm, and each arm is of rounded form when viewed from the side.

With advantage the handle has a central boss with a downwardly opening bore in which the top of the screw is secured, each arm having a depth which narrows towards the central boss and being joined to the boss by a concave curved depression at the lower side so as to accommodate the fingers of a user. The handle is preferably moulded from plastics material in a single piece.

The central boss oreferably has a lower portion which is elastically flexible inwardly so that it can be a snap fit in the holder of a self-pull type corkscrew assembly.

In another aspect the invention provides a corkscrew assembly of the self-pull type comprising a screw member and a holding member, the screw member comprising a screw having a lower end adapted to be inserted into a cork and an upper end secured to a handle by which the screw member may be rotated about the axis of the screw, the holding member having a body formed with a bore to loosely receive the screw and a pair of arms extending downwardly therefrom and arranged to engage the top of and opposite sides of the neck of a bottle, the arrangement being such that initially as the screw member is rotated the screw enters the cork while further rotation causes the cork to be pulled from the neck of the bottle, and in which a projecting portion on the lower part of the handle is a retaining fit in the bore of the holding member when the screw is fully inserted into the holding member so as to retain the members together in that position against inadvertent separation, but allow the member to be pulled apart for use.

BRIEF DESCRIPTION OF THE DRAWINGS

One embodiment of corkscrew assembly, in accordance with the invention, will now be described, by way of example only, with reference to the accompanying drawings of which.

DETAILED DESCRIPTION OF ONE EMBODIMENT

Figure 1:
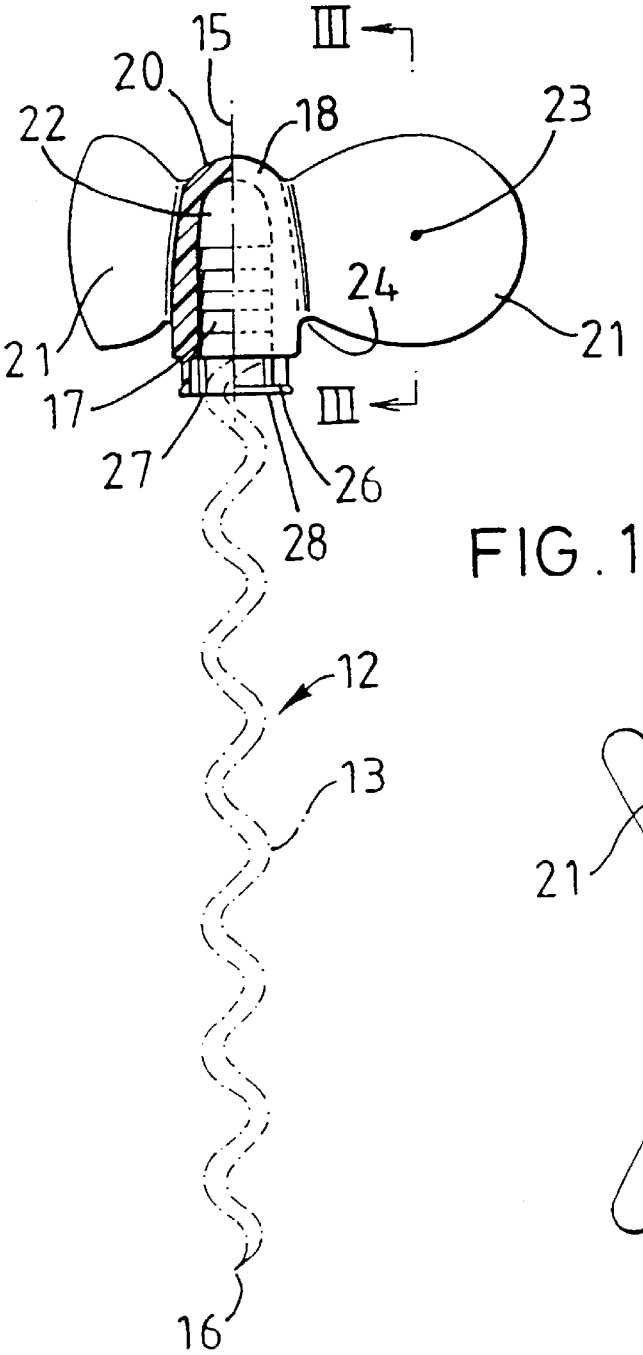
FIG. 1 is a side view of a screw member of a corkscrew assembly.
Figure 2:
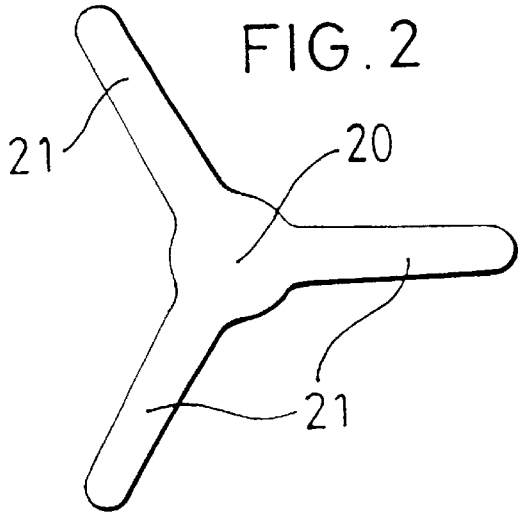
FIG. 2 is a plan view of the screw member.

Referring to the drawings, a corkscrew comprises a screw member 12 having a screw 13 in the form of a wire wound into a helix about an axis 15, the screw having a pointed lower end 16 (adapted for insertion into the cork of a bottle) substantially on the axis and having an upper end 17 which is more closely wound and is glued, or otherwise secured, to a handle 18. The handle is moulded in a single piece from plastics material and comprises a central boss 20 rounded in plan and side view, and three similar arms at 21 extending outwardly from the boss, equi-angularly spaced about the axis 15 and each having a rounded shape in side view. The central boss is formed with a downwardly opening blind bore 22 in which the upper end 17 of the screw is located. Each arm has a substantial depth, at least 20 mm, and in this case the majority of the shape in side view is circular of 14 mm diameter centred about point 23. The arms are each joined to the boss by a radius at the top and the bottom so as to provide, at least at the bottom, a concave depression 24 adjacent the boss, which depression can accommodate a finger.

Figure 3:
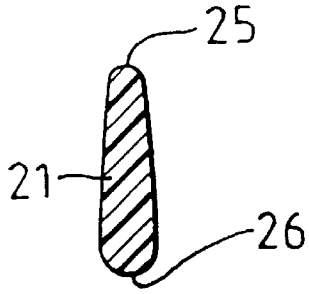
FIG. 3 is a section on the line III—III of FIG. 1.
Figure 4:
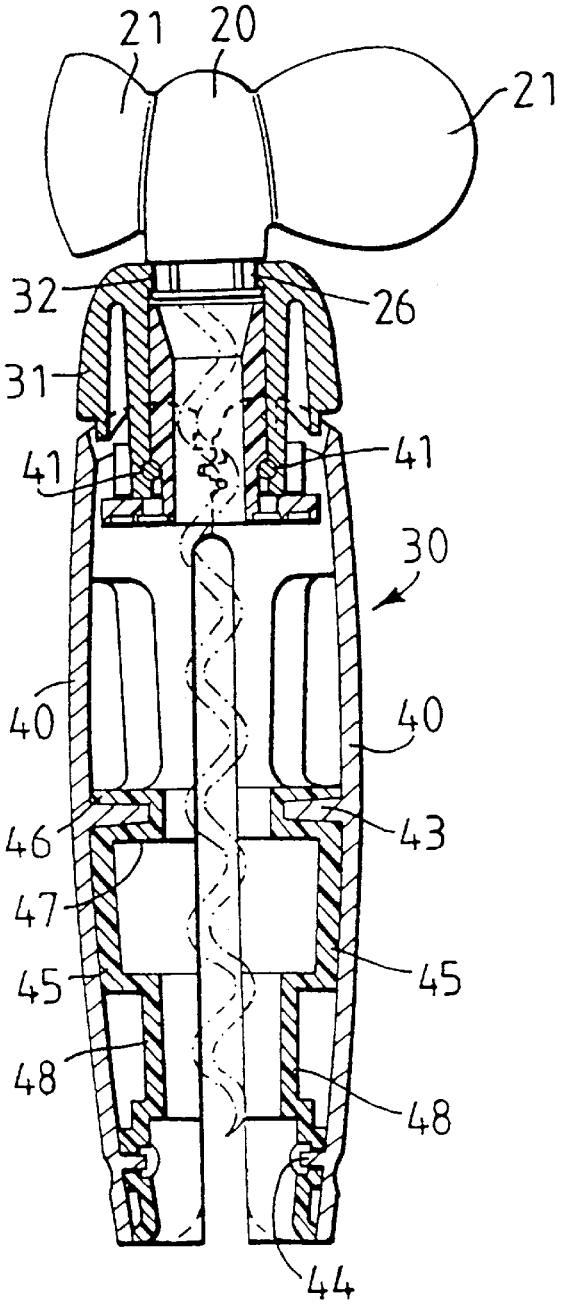
FIG. 4 is a part sectional view of a self-pull type corkscrew assembly including the screw member of FIGS. 1–3.
Figure 11:
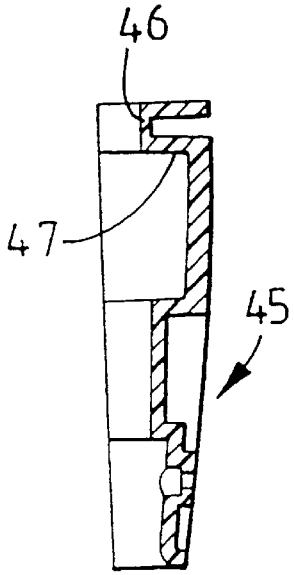
FIG. 11 is a section through one insert for one arm.

In section, as seen in FIG. 3, each arm 21 is wider at the bottom than at the top and each has a rounded top 25 and a rounded bottom 26.

The design of the handle is ergonomically more efficient than the conventional two-armed corkscrew handles.

The screw member is designed to be part of self-pull corkscrew assembly including a holding member 30. For this purpose the lower end of the boss 20 has a short downward extension 26 which is elastically flexible inwardly. The extension 26 comprises a thin walled (approximately 0.15 mm thickness) annulus formed with four vertical slots 27. The extension 26 is designed to be a snap-fit into the upper stepped bore of the holding member when the screw member is fully inserted into the holding member but does not engage with the holding member until shortly before full engagement. This reduces frictional drag. The lower part of the extension 26 has an outwardly raised rim 28.

Figure 5:
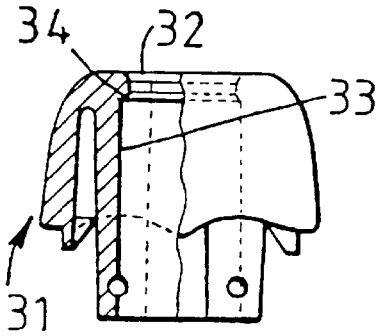
FIG. 5 is a art sectional view of the body of the holding member of the assembly of FIG. 4.
Figure 8:
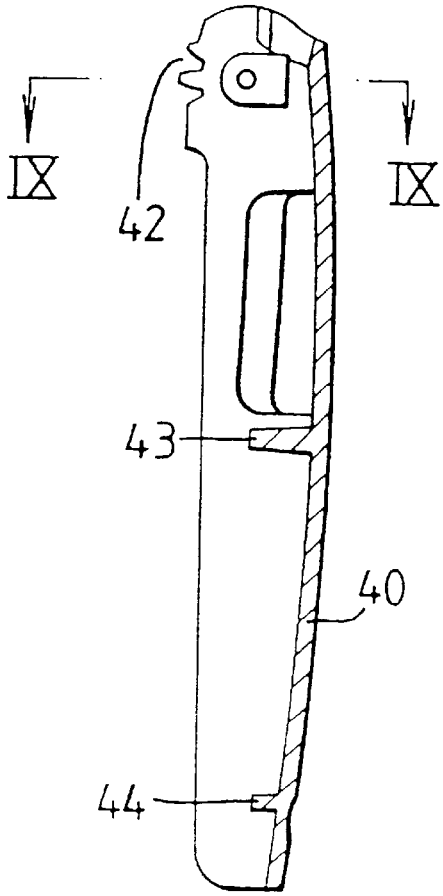
FIG. 8 is a vertical section through one arm of the holding member.
Figure 6:
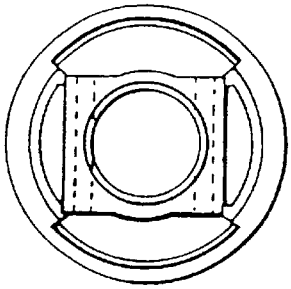
FIG. 6 is a bottom plan view of the body of FIG. 5.
Figure 7:
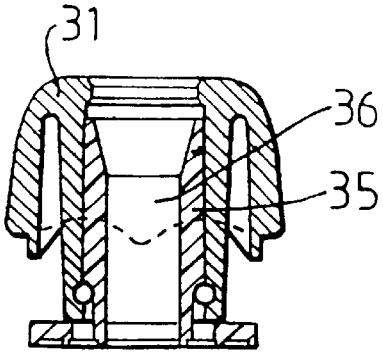
FIG. 7 is a sectional view of the body fitted with an inner sleeve.

The holding member 30 comprises a metal body 31 defining a stepped bore, the upper part 32 of which bore is of smaller diameter than the lower part 33 defining a shoulder 34 between the parts. The extension 26 of the boss 20 of the handle is sized to provide the snap-fit engagement with the upper bore part 32, with the rim 28 locating behind the shoulder 34 when screw member is fully inserted into the holding member. As seen in FIG. 5 the upper bore part 32 is radiused so that the wails of the bore are convex; this assists the snap-fit engagement. The retaining force is such that the handle and holding member will not inadvertently disengage from this fully inserted position during storage and transport but the members can be easily pulled completely apart when required for use.

The stepped bore or shoulder could be replaced by a groove in which the rim 28 locates or the parts can simply engage with a frictional force sufficient to provide a retaining fit between the members when fully engaged to resist inadvertent separation.

A plastic tubular sleeve 35 is secured in the lower bore part 33 and has a passage 36 therethrough, through which the screw 13 can pass loosely.

Figure 10:
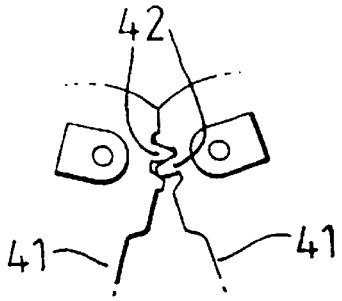
FIG. 10 is a view showing the meshing of the pinions of the two arms in their open position.

The holding member includes a pair of metal arms 40 pivotally attached by horizontally extending pins 41 so as to depend from opposite sides of the body 31, so that the arms have limited pivotal movement about the horizontal axes of the pins towards and away from one another. Each arm is formed with pinion teeth 42 adjacent its upper inner edge, the teeth of one arm being arranged to engage with the teeth of the other arm so that the arms pivot outwardly or inwardly together, as seen in FIG. 10.

Figure 9:
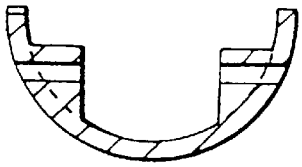
FIG. 9 is a sectional view on the line IX—IX of FIG. 8.

Each arm 40 is of generally semi-circular section as seen in FIG. 9 and has inward projections 43, 44 by which a semi-circular sectioned plastic material insert 45 is located on its inner side. The projections 43 and top parts 46 of the inserts provide a downwardly facing engagement surface 47 for locating the holding member on the top of a bottle neck.

In use the arms 40 are pulled apart sufficiently for the holding member to be located on the bottle top and the arms are then pivoted inwardly and held with the parts 48 of the inserts engaging the bottle neck. The screw member is inserted through the passage 36 in the sleeve 35 and rotated to screw the screw into the cork in the bottle neck. When the screw member is fully inserted into the holding member so that there is the snap-fit engagement between the screw member and the holding member, the handle boss 20 engages the top of the body 31 of the holding member to prevent further inward movement of the screw member. Continued rotation of the screw in the same direction then causes the cork to be extracted from the bottle and drawn up into the space between the arms above the bottle top.

The snap engagement between the boss extension 26 and the bore 32 does not provide any substantial resistance to this further rotation, nor does the loose engagement of the screw in the passage 36.

What is claimed is:

1. A corkscrew assembly of the self-pull type comprising a screw member and a holding member from which the screw member is separable, the screw member comprising a screw having an axis, a lower end adapted to be inserted into a cork and an upper end secured to a handle by which the screw member may be rotated about the axis, the holding member having a body formed with a bore to receive the screw and a pair of arms extending downwardly therefrom and arranged to engage a top of and opposite sides of a neck of a bottle, the arrangement being such that initially as the screw member is rotated the screw enters the cork while further rotation causes the cork to be pulled from the neck of the bottle, characterised in that the screw is loosely received in the bore and a lower part of the handle has a projecting portion which is a snap fit in the bore of the holding member when the screw member is substantially fully inserted into the holding member, so as to retain the screw member and holding member together against inadvertent separation only in that substantially fully inserted position.

2. An assembly according to claim 1 in which the projecting portion is flexible inwardly.

3. An assembly according to claim 2 in which the projecting portion is of thin walled annular construction and is formed with at least one slit to provide flexibility.

4. An assembly according to claim 1 in which the projecting portion has a lower part having an outwardly projecting rim.

5. An assembly according to claim 1 in which the bore of the holding member is stepped to accommodate a rim on a lower part of the handle projection.

6. An assembly according to claim 1 in which the holding member has a wall defining the bore, which wall is convexly radiused.

7. An assembly according to claim 1 in which the body and arms of the holding member are made of metal or metal alloy and the bore the body and an inner surface of each of the arms are defined by plastic material inserts.

* * * * *